US012606916B2

(12) United States Patent
Urschey et al.

(10) Patent No.: US 12,606,916 B2
(45) Date of Patent: Apr. 21, 2026

(54) METHOD FOR REDUCING OR PREVENTING CORROSION OR FOULING CAUSED BY ACIDIC COMPOUNDS

(71) Applicant: KURITA WATER INDUSTRIES LTD., Tokyo (JP)

(72) Inventors: Michael Urschey, Ludwigshafen (DE); Ingo Schmalohr, Ludwigshafen (DE); Philipp Schmidt, Ludwigshafen (DE)

(73) Assignee: KURITA WATER INDUSTRIES LTD., Tokyo (JP)

( * ) Notice: Subject to any disclaimer, the term of this patent is extended or adjusted under 35 U.S.C. 154(b) by 934 days.

(21) Appl. No.: 17/640,383

(22) PCT Filed: Jan. 30, 2020

(86) PCT No.: PCT/JP2020/003427
§ 371 (c)(1),
(2) Date: Mar. 4, 2022

(87) PCT Pub. No.: WO2021/152773
PCT Pub. Date: Aug. 5, 2021

(65) Prior Publication Data
US 2022/0364242 A1 Nov. 17, 2022

(51) Int. Cl.
*C23F 11/14* (2006.01)
*C10G 7/10* (2006.01)
(Continued)

(52) U.S. Cl.
CPC ..... *C23F 11/141* (2013.01); *C10G 7/10* (2013.01); *C10G 35/00* (2013.01); *C10G 47/00* (2013.01);
(Continued)

(58) Field of Classification Search
None
See application file for complete search history.

(56) References Cited

U.S. PATENT DOCUMENTS 4,300,995 A * 11/1981 Liotta ..... C10G 1/00 208/422
5,683,626 A 11/1997 Sartori et al.
(Continued)

FOREIGN PATENT DOCUMENTS

CN 103571538 A 2/2014
CN 105925987 A 9/2016
(Continued)

OTHER PUBLICATIONS

Patent Cooperation Treaty, International Search Report and Written Opinion for PCT/JP2020/003427, 9 pages, dated Apr. 14, 2020.

*Primary Examiner* — Joseph D Anthony
(74) *Attorney, Agent, or Firm* — Viksnins Harris Padys Malen LLP

(57) ABSTRACT

A method for reducing or preventing corrosion or fouling in an apparatus for carrying out a chemical process, where corrosion or fouling is caused by acidic compounds present in the chemical process, which comprises the addition of at least one quaternary ammonium hydroxide of the formula (I) to the apparatus, wherein the chemical process is carried out: [Chem. 1] where $R^1$, $R^2$, $R^3$ are each independently $C_1$-$C_{10}$ alkyl; $R^4$ is inter alia $C_1$-$C_{18}$ alkyl, benzyl, monocycloalkyl having 5, 6, 7 or 8 carbon atoms, bicycloalkyl having 6 to 8 carbon atoms, tricycloalkyl having 7 to 10 carbon atoms, where monocycloalkyl, bicycloalkyl and tricycloalkyl are unsubstituted or substituted by 1 or 2 methyl groups, or tri-$C_1$-$C_4$ alkyl ammonium groups. $R^1$ and $R^2$ together with the nitrogen atom may also form a 5 or 6-membered, saturated nitrogen heterocycle, which is unsubstituted or carries 1 or 2 methyl groups; and/or $R^3$ and $R^4$ together with the nitrogen atom may also form a 5 or 6-membered, saturated nitrogen heterocycle, which is unsubstituted or carries 1 or 2 methyl groups.

14 Claims, 1 Drawing Sheet

1 Propene
2 Methylchloride
3 Vinylchloride
4 Trimethylamine
5 Ethylchloride
6 N-Methylaziridine
7 Ethyldimethylamine
8 1,2-Dimethylaziridine
9 Isobutyronitrile
10 Diethylmethylamine

(51) Int. Cl.

| | |
|---|---|
| ***C10G 35/00*** | (2006.01) |
| ***C10G 47/00*** | (2006.01) |
| ***C10G 75/02*** | (2006.01) |
| ***C10G 75/04*** | (2006.01) |
| ***C23F 11/04*** | (2006.01) |
| ***C23F 14/02*** | (2006.01) |

(52) U.S. Cl.
CPC ..... *C10G 75/02* (2013.01); *C10G 75/04* (2013.01); *C23F 11/04* (2013.01); *C23F 14/02* (2013.01)

(56) References Cited

U.S. PATENT DOCUMENTS

| | | | | |
|---|---|---|---|---|
| 6,103,100 | A * | 8/2000 | Hart | C10G 75/02 208/252 |
| 7,279,089 | B2 | 10/2007 | Vercammen | |
| 7,514,657 | B2 * | 4/2009 | Moreira | C10G 32/02 208/263 |
| 8,177,962 | B2 * | 5/2012 | Koizumi | C23F 11/142 252/387 |
| 2004/0238405 | A1 | 12/2004 | Vercammen | |
| 2006/0043340 | A1 | 3/2006 | Koizumi et al. | |
| 2011/0155558 | A1 * | 6/2011 | Cardoso | B01J 8/20 977/700 |
| 2021/0341109 | A1 | 11/2021 | Sellen et al. | |

FOREIGN PATENT DOCUMENTS

| | | | |
|---|---|---|---|
| CN | 110408422 | A | 11/2019 |
| EP | 2348142 | A1 | 7/2011 |
| JP | H05186737 | A | 7/1993 |
| JP | 2022504633 | A | 1/2022 |
| WO | 2001079396 | A1 | 10/2001 |
| WO | 2010046134 | A1 | 4/2010 |

* cited by examiner

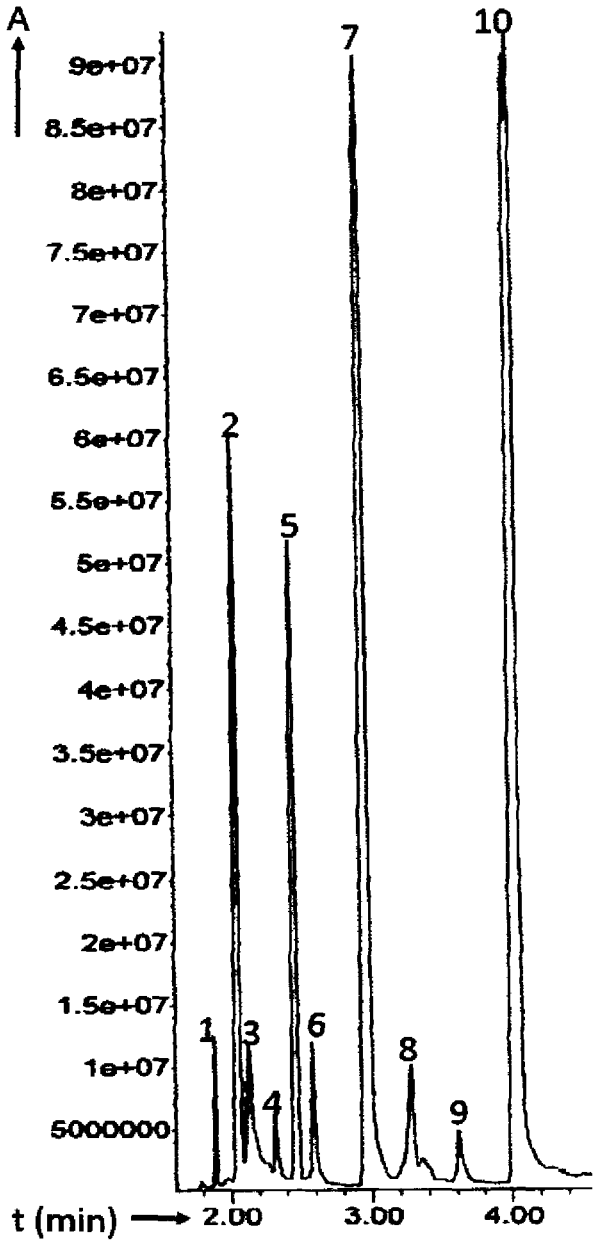
1 Propene
2 Methylchloride
3 Vinylchloride
4 Trimethylamine
5 Ethylchloride
6 N-Methylaziridine
7 Ethyldimethylamine
8 1,2-Dimethylaziridine
9 Isobutyronitrile
10 Diethylmethylamine

METHOD FOR REDUCING OR PREVENTING CORROSION OR FOULING CAUSED BY ACIDIC COMPOUNDS

FIELD OF THE INVENTION

The invention relates to a method for reducing or preventing corrosion or fouling which is caused by acidic compounds, such as acids, e.g. hydrogen chloride, or acidic ammonium salts, e.g. ammonium chloride, which are present or formed in a chemical process, such as a petrochemical process. The method comprises the step of adding at least one quaternary ammonium hydroxide of the present invention to an apparatus that is used to carry out the chemical process.

BACKGROUND OF THE INVENTION

Corrosion and fouling are severe problems in chemical production facilities, especially in crude oil processing plants such as crude oil refineries and petrochemical plants, because they lead to the deterioration of the process equipment and are therefore associated with economical loss as well as health and environmental hazards. A major cause of corrosion and fouling are ammonium salts, e.g. ammonium halides of organic and inorganic nature, ammonium sulfate or ammonium hydrogensulfate, since they have corrosive effects in gaseous, solid or dissolved form and can also contribute to the build-up of deposits that may cause hydraulic or thermal obstructions in various system components. The ammonium salts are typically introduced into the process as part of the fed raw materials, such as crude oil, but may also be formed during the chemical process. In addition, corrosion in crude oil refinery plants and petrochemical plants and other chemical facilities may originate from acidic compounds, such as in particular hydrogen chloride, which are generated in the course of the process. For example, in a crude oil distillation unit hydrogen chloride can be formed via hydrolysis of calcium chloride or magnesium chloride still present in the desalted crude oil that is fed into the unit.

U.S. Pat. Nos. 7,279,089 and 8,177,962 describe methods for preventing corrosion and fouling in petrochemical processes by neutralizing acidic components, such as ammonium chloride or hydrogen chloride, with choline hydroxide that is introduced into the respective process units. It is said that choline hydroxide has advantageous properties over ammonia and other amines commonly used so far for such applications. First of all, choline hydroxide is much more basic and thus enables lower molar dosages and a more effective pH control. Moreover, due to its higher basicity, choline hydroxide reacts with acidic compounds to form salts whose aqueous solutions have higher pH values. This way the risk of secondary corrosion caused by neutralization salts is greatly reduced. In addition, said neutralization salts of choline hydroxide are strongly hygroscopic and therefore are capable to absorb even traces of moisture to readily form flowable solutions, which allow easy removal of the salts from process streams.

However, the use of choline hydroxide for mitigating fouling and corrosion also entails several disadvantages. Firstly, aqueous solutions of choline hydroxide have limited thermal stability at temperatures above 180° C. and additionally develop unpleasant odors and discolor during extended storage.

Despite the advances made in the field of prevention and control of corrosion as well as fouling, there is still an ongoing need for an effective and economically viable method for combating corrosion and fouling in chemical processes, especially chemical processes, where high temperatures will occur. It is therefore the object of the present invention to provide such a method, which in particular features all the advantages of the aforementioned prior art procedures using choline hydroxide to mitigate corrosion and fouling, but also avoids the limitations of these procedures. Thus, the corrosion and fouling reducing or preventing compound used in this method, as well as aqueous solutions thereof, should have sufficient thermal and storage stabilities and should in particular withstand temperatures well above 180° C. without undergoing significant decomposition. Such temperatures prevail, for example, in some fluid or gaseous streams of refinery and petrochemical systems, such as hydrodesulfurization plants. Said compound should additionally have improved basicity and a superior ability to dissolve ammonium salts in comparison to choline hydroxide.

The object is achieved by the method described in detail below.

SUMMARY OF THE INVENTION

The present invention relates to a method for reducing or preventing corrosion or fouling in an apparatus for carrying out a chemical process, where corrosion or fouling is caused by acidic compounds present in the chemical process, which comprises the addition of at least one quaternary ammonium hydroxide of the formula (I) to the apparatus, wherein the chemical process is carried out:

[Chem. 1]

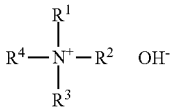

(I)

where $R^1$, $R^2$, $R^3$ are each independently $C_1$-$C_{10}$ alkyl;

$R^4$ is selected from the group consisting of $C_1$-$C_{18}$ alkyl, benzyl, monocycloalkyl having 5, 6, 7 or 8 carbon atoms, bicycloalkyl having 6 to 8 carbon atoms, tricycloalkyl having 7 to 10 carbon atoms, where monocycloalkyl, bicycloalkyl and tricycloalkyl are unsubstituted or substituted by 1 or 2 methyl groups, and groups of the formulae $R^{4a}$ and $R^{4b}$;

[Chem. 2]

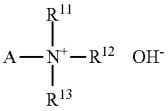

$R^{4a}$

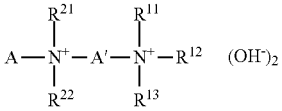

$R^{4b}$ where

A is $C_2$-$C_8$ alkandiyl;

A' is $C_2$-$C_8$ alkandiyl; and $R^{11}$, $R^{12}$, $R^{13}$, $R^{21}$, $R^{22}$ are each independently $C_1$-$C_4$ alkyl;

$R^1$ and $R^2$ together with the nitrogen atom may also form a 5 or 6-membered, saturated nitrogen heterocycle, which is unsubstituted or carries 1 or 2 methyl groups; and/or $R^3$ and $R^4$ together with the nitrogen atom may also form a 5 or 6-membered, saturated nitrogen heterocycle, which is unsubstituted or carries 1 or 2 methyl groups.

The invention further relates to the use of the quaternary ammonium hydroxide of formula (I) for reducing or preventing corrosion or fouling in an apparatus for carrying out a chemical process, where corrosion or fouling is caused by acidic compounds present in the chemical process.

BRIEF DESCRIPTION OF DRAWINGS

FIG. 1 is GC/MS partial chromatogram of DEDMA-Cl pyrolysis products formed under the conditions of example 10.

DETAILED DESCRIPTION OF THE INVENTION

In the context of the present invention, the terms and phrases used herein generically are defined as follows:

The prefix "$C_x$-$C_y$" denotes the number of possible carbon atoms in the particular case.

The term "$C_1$-$C_{18}$-alkyl" as used herein refers to saturated straight-chain or branched hydrocarbon radicals having 1 to 4 ("$C_1$-$C_4$-alkyl"), 1 to 6 ("$C_1$-$C_6$-alkyl"), 1 to 10 ("$C_1$-$C_{10}$-alkyl") or 1 to 18 ("$C_1$-$C_{18}$-alkyl") carbon atoms. $C_1$-$C_4$-Alkyl is methyl, ethyl, n-propyl, isopropyl, n-butyl, 1-methyl-n-propyl (sec-butyl), 2-methyl-n-propyl (isobutyl) or 1,1-dimethylethyl (tert-butyl). $C_1$-$C_6$-Alkyl is additionally, for example, n-pentyl, 1-methyl-n-butyl, 2-methyl-n-butyl, 3-methyl-n-butyl, 2,2-dimethyl-n-propyl, 1-ethyl-n-propyl, 1,1-dimethyl-n-propyl, 1,2-dimethyl-n-propyl, n-hexyl, 1-methyl-n-pentyl, 2-methyl-n-pentyl, 3-methyl-n-pentyl, 4-methyl-n-pentyl, 1,1-dimethyl-n-butyl, 1,2-dimethyl-n-butyl, 1,3-dimethyl-n-butyl, 2,2-dimethyl-n-butyl, 2,3-dimethyl-n-butyl, 3,3-dimethyl-n-butyl, 1-ethyl-n-butyl, 2-ethyl-n-butyl, 1,1,2-trimethyl-n-propyl, 1,2,2-trimethyl-n-propyl, 1-ethyl-1-methyl-n-propyl, or 1-ethyl-2-methyl-n-propyl. $C_1$-$C_{10}$-Alkyl is additionally also, for example, n-heptyl, n-octyl, 2-ethyl-n-hexyl, n-nonyl, n-decyl and positional isomers thereof. $C_1$-$C_{18}$-Alkyl is additionally also, for example, n-undecyl, n-dodecyl, n-tridecyl, n-tetradecyl, n-pentadecyl, n-hexadecyl, n-heptadecyl, n-octadecyl and positional isomers thereof.

The term "monocycloalkyl having 5, 6, 7 or 8 carbon atoms" as used herein refers to monocyclic $C_5$-$C_8$-cycloalkyl radicals, namely cyclopentyl, cyclohexyl, cycloheptyl and cyclooctyl.

The term "bicycloalkyl having 6 to 8 carbon atoms" as used herein refers to a bridged alicyclic $C_6$-$C_8$-hydrocarbyl radical containing two bridgehead carbon atoms. Examples include, but are not limited to, bicyclo[2.1.1]hexyl, bicyclo[2.2.1]heptyl, which is also known as norbornyl, bicyclo[3.2.0]heptyl, bicyclo[4.1.0]heptyl, bicyclo[3.2.1]octyl and bicyclo[2.2.2]octyl.

The term "tricycloalkyl having 7 to 10 carbon atoms" as used herein refers to a bridged alicyclic $C_7$-$C_{10}$-hydrocarbyl group possessing four bridgehead carbons each common to three rings. Examples include, but are not limited to tricyclo[$3.3.1.1^{3,7}$]decanyl and tricyclo[$5.2.1.0^{2,6}$]decanyl, which are also known as adamantyl and tetrahydrodicyclopentadienyl, respectively.

The term "$C_2$-$C_8$-alkandiyl" as used herein refers to a bivalent, saturated, aliphatic hydrocarbon diradical having 2 to 8 carbon atoms. Examples of $C_2$-$C_8$-alkandiyl are in particular linear alkandiyl such as 1,2-ethandiyl, 1,3-n-propandiyl, 1,4-n-butandiyl, 1,5-n-pentandiyl, 1,6-n-hexandiyl, 1,7-n-heptandiyl and 1,8-n-octandiyl, but also branched alkandiyl such as 1-methyl-1,2-ethandiyl, 1-methyl-1,2-n-propandiyl, 2-methyl-1,3-n-butandiyl, 1,3-n-pentandiyl, 2-ethyl-1,6-n-hexandiyl and the like.

The term "5- or 6-membered, saturated nitrogen heterocycle" as used herein refers to a saturated monocyclic ring containing one nitrogen atom as ring member, namely pyrrolidinyl and piperidinyl.

The term "crude oil processing plants" includes plants where crude oil is processed, such as crude oil refinery plants and petrochemical plants and plants, where crude oil refinery processes and petrochemical processes are combined in a network.

In formula (I) the variables $R^1$, $R^2$, $R^3$, $R^4$, $R^{4a}$, $R^{4b}$, $R^{11}$, $R^{12}$, $R^{13}$, $R^{21}$, $R^{22}$, A and A' on their own or in any combination preferably have the following meanings:

Irrespective of their occurrence, the variables $R^1$, $R^2$ and $R^3$ are same or different and preferably selected from $C_1$-$C_6$-alkyl, in particular selected from $C_1$-$C_4$-alkyl, i.e. from the group consisting of methyl, ethyl, n-propyl, isopropyl, n-butyl, sec-butyl, isobutyl and tert-butyl. Especially, $R^1$, $R^2$ and $R^3$ are identical or different and selected from the group consisting of methyl, ethyl, n-propyl and n-butyl.

Alternatively, the variables $R^1$ and $R^2$ may, together with the nitrogen atom to which they are bound, preferably form a 5 or 6-membered, saturated nitrogen heterocycle, which carries one methyl group or is preferably unsubstituted, while $R^3$ and $R^4$ are as defined herein and preferably have the meanings, which are given as preferred.

Irrespective of their occurrence, the variables $R^{11}$, $R^{12}$, $R^{13}$, $R^{21}$ and $R^{22}$, if present in the quaternary ammonium hydroxide of formula (I), are identical or different and preferably selected from $C_1$-$C_4$-alkyl, i.e. from the group consisting of methyl, ethyl, n-propyl, isopropyl, n-butyl, sec-butyl and isobutyl, more preferably from the group consisting of methyl, ethyl, n-propyl and n-butyl, and especially from the group consisting of methyl and ethyl. Particularly preferred $R^{11}$, $R^{12}$, $R^{13}$, $R^{21}$ and $R^{22}$, if present, are each methyl.

The variable A is preferably a linear $C_2$-$C_8$-alkandiyl diradical, and more preferably a linear $C_2$-$C_6$-alkandiyl diradical. Particularly preferred the variable A is hexandiyl.

The variable A' is preferably a linear $C_2$-$C_8$-alkandiyl diradical, and more preferably a linear $C_2$-$C_6$-alkandiyl diradical.

The variable $R^{4a}$ is selected from the group consisting of the hydroxide salts of 2-(trimethylammonium)ethyl, 3-(trimethylammonium)-n-propyl, 4-(trimethylammonium)-n-butyl, 5-(trimethylammonium)-n-pentyl and 6-(trimethylammonium)-n-hexyl, and in particular is the hydroxide salt of 6-(trimethylammonium)-n-hexyl.

The variable $R^{4b}$ is selected from the group consisting of the dihydroxide salts of 2-(trimethylammonium)ethyl-(dimethylammonium)ethyl, 3-(trimethylammonium)-n-prop-1-yl-(dimethylammonium)-n-propyl, 4-(trimethylammonium)-n-but-1-yl-(dimethylammonium)-n-butyl, 5-(trimethylammonium)-n-pent-1-(dimethylammonium)-n-pentyl and 6-(trimethylammonium)-n-hex-1-yl-(dimethylammonium)-n-hexyl.

The variable $R^4$ is preferably selected from the group consisting of $C_1$-$C_{10}$-alkyl, benzyl, cyclopentyl, cyclohexyl bicycloalkyl having 7 or 8 carbon atoms, tricycloalkyl having 9 or 10 carbon atoms, where monocycloalkyl, bicycloalkyl and tricycloalkyl are unsubstituted or substituted by 1 or 2 methyl groups, and groups of the formula $R^{4a}$, where the variables $R^{11}$, $R^{12}$, $R^{13}$ and A in formula $R^{4a}$ have the meanings defined herein, in particular the preferred meanings. More preferably $R^4$ is selected from the group consisting of $C_1$-$C_4$-alkyl, benzyl, cyclopentyl, cyclohexyl, norbornyl, 7,7-dimethylnorbornyl, bicyclo[3.2.0]heptyl, bicyclo[4.1.0]heptyl, bicyclo[3.2.1]octyl, bicyclo[2.2.2]octyl, adamantyl, 1-methyladamantyl, 1,3-dimethyladamantyl, tetrahydrodicyclopentadienyl, and the hydroxide salt of 6-(trimethylammonium)hexyl. $R^4$ is in particular selected from the group consisting of methyl, ethyl, n-propyl, isopropyl, n-butyl, sec-butyl, isobutyl, benzyl, cyclopentyl, cyclohexyl, norbornyl, adamantyl and the hydroxide salt of 6-(trimethylammonium)hexyl, and specifically selected from methyl, ethyl, n-propyl, n-butyl, benzyl, adamantyl, and the hydroxide salt of 6-(trimethylammonium)hexyl.

Alternatively, the variables $R^3$ and $R^4$ may, together with the nitrogen atom to which they are bound, preferably form a 5 or 6-membered, saturated nitrogen heterocycle, which carries one methyl group or is preferably unsubstituted, while $R^1$ and $R^2$ are as defined herein and preferably have the meanings, which are given as preferred.

In one preferred group of embodiments the variables $R^1$, $R^2$, $R^3$ and $R^4$ in the quaternary ammonium hydroxide of the formula (I) are defined as follows:

$R^1$, $R^2$ and $R^3$ are same or different and selected from $C_1$-$C_6$-alkyl, in particular selected from $C_1$-$C_4$-alkyl, i.e. from the group consisting of methyl, ethyl, n-propyl, isopropyl, n-butyl, sec-butyl, isobutyl and tert-butyl. Especially, $R^1$, $R^2$ and $R^3$ are identical or different and selected from the group consisting of methyl, ethyl, n-propyl and n-butyl;

$R^4$ is selected from the group consisting of $C_1$-$C_{10}$-alkyl, benzyl, cyclopentyl, cyclohexyl, bicycloalkyl having 7 or 8 carbon atoms, tricycloalkyl having 9 or 10 carbon atoms, where monocycloalkyl, bicycloalkyl and tricycloalkyl are unsubstituted or substituted by 1 or 2 methyl groups, and groups of the formula $R^{4a}$, where the variables $R^{11}$, $R^{12}$, $R^{13}$ and A in formula $R^{4a}$ have the meanings defined herein, in particular the preferred meanings. More preferably $R^4$ is selected from the group consisting of $C_1$-$C_4$-alkyl, benzyl, cyclopentyl, cyclohexyl, norbornyl, 7,7-dimethylnorbornyl, bicyclo[3.2.0]heptyl, bicyclo[4.1.0]heptyl, bicyclo[3.2.1]octyl, bicyclo[2.2.2]octyl, adamantyl, 1-methyl-adamantyl, 1,3-dimethyladamantyl, tetrahydrodicyclopentadienyl, and the hydroxide salt of 6-(trimethylammonium)hexyl. $R^4$ is in particular selected from the group consisting of methyl, ethyl, n-propyl, isopropyl, n-butyl, sec-butyl, isobutyl, benzyl, cyclopentyl, cyclohexyl, norbornyl, adamantyl and the hydroxide salt of 6-(trimethylammonium)hexyl, and specifically selected from methyl, ethyl, n-propyl, n-butyl, benzyl, adamantyl, and the hydroxide salt of 6-(trimethylammonium)hexyl.

In another preferred group of embodiments the variables $R^1$, $R^2$, $R^3$ and $R^4$ in the quaternary ammonium hydroxide of the formula (I) are defined as follows:

$R^1$ and $R^2$, together with the nitrogen atom to which they are bound, form a 5 or 6-membered, saturated nitrogen heterocycle, which carries one methyl group or is preferably unsubstituted, $R^3$ is selected from $C_1$-$C_6$-alkyl, in particular selected from $C_1$-$C_4$-alkyl, i.e. from the group consisting of methyl, ethyl, n-propyl, isopropyl, n-butyl, sec-butyl, isobutyl and tert-butyl. Especially, $R^3$ is selected from the group consisting of methyl, ethyl, n-propyl and n-butyl.

$R^4$ is selected from the group consisting of $C_1$-$C_{10}$-alkyl, benzyl, cyclopentyl, cyclohexyl, bicycloalkyl having 7 or 8 carbon atoms, tricycloalkyl having 9 or 10 carbon atoms, where monocycloalkyl, bicycloalkyl and tricycloalkyl are unsubstituted or substituted by 1 or 2 methyl groups, and groups of the formula $R^{4a}$, where the variables $R^{11}$, $R^{12}$, $R^{13}$ and A in formula $R^{4a}$ have the meanings defined herein, in particular the preferred meanings. More preferably $R^4$ is selected from the group consisting of $C_1$-$C_4$-alkyl, benzyl, cyclopentyl, cyclohexyl, norbornyl, 7,7-dimethylnorbornyl, bicyclo[3.2.0]heptyl, bicyclo[4.1.0]heptyl, bicyclo[3.2.1]octyl, bicyclo[2.2.2]octyl, adamantyl, 1-methyladamantyl, 1,3-dimethyladamantyl, tetrahydrodicyclopentadienyl, and the hydroxide salt of 6-(trimethylammonium)hexyl. $R^4$ is in particular selected from the group consisting of methyl, ethyl, n-propyl, isopropyl, n-butyl, sec-butyl, isobutyl, benzyl, cyclopentyl, cyclohexyl, norbornyl, adamantyl and the hydroxide salt of 6-(trimethylammonium)hexyl, and specifically selected from methyl, ethyl, n-propyl, n-butyl, benzyl, adamantyl, and the hydroxide salt of 6-(trimethylammonium)hexyl.

In a further preferred group of embodiments the variables $R^1$, $R^2$, $R^3$ and $R^4$ in the quaternary ammonium hydroxide of formula (I) are defined as follows:

$R^1$ and $R^2$, together with the nitrogen atom to which they are bound, form a 5 or 6-membered, saturated nitrogen heterocycle, which carries one methyl group or is preferably unsubstituted, $R^3$ and $R^4$, together with the nitrogen atom to which they are bound, form a 5 or 6-membered, saturated nitrogen heterocycle, which carries one methyl group or is preferably unsubstituted.

In a particular preferred group of embodiments $R^1$, $R^2$, $R^3$ are each independently $C_1$-$C_6$-alkyl, preferably are each independently $C_1$-$C_4$-alkyl, and in particular are independently selected from methyl, ethyl, n-propyl and n-butyl; and $R^4$ is $C_1$-$C_{18}$-alkyl, benzyl, cyclopentyl, cyclohexyl, $C_7$-$C_8$-bicycloalkyl, $C_9$-$C_{10}$-tricycloalkyl or the hydroxide salt of 6-(trimethylammonium)hexyl, and preferably is $C_2$-$C_{10}$-alkyl, benzyl, norbornyl, adamantyl or the hydroxide salt of 6-(trimethylammonium)hexyl.

In a further particular preferred group of embodiments $R^1$ and $R^2$ together with the nitrogen atom they are bound to form a 5 or 6-membered, saturated nitrogen heterocycle which is unsubstituted or carries 1 or 2 methyl groups, preferably form a 5 or 6-membered, saturated nitrogen heterocycle which is unsubstituted, and in particular form an unsubstituted pyrrolidinium ring;

$R^3$ is $C_1$-$C_6$-alkyl, preferably are each independently $C_1$-$C_4$-alkyl, and in particular are independently selected from methyl, ethyl, n-propyl and n-butyl; and $R^4$ is $C_1$-$C_{18}$-alkyl, benzyl, cyclopentyl, cyclohexyl, $C_7$-$C_8$-bicycloalkyl, $C_9$-$C_{10}$-tricycloalkyl or the hydroxide salt of 6-(trimethyl-ammonium)hexyl, and preferably is $C_2$-$C_{10}$- alkyl, benzyl, norbornyl, adamantyl or the hydroxide salt of 6-(trimethylammonium)hexyl.

In yet a further particular preferred group of embodiments $R^1$ and $R^2$ together with the nitrogen atom they are bound to form a 5 or 6-membered, saturated nitrogen heterocycle which is unsubstituted or carries 1 or 2 methyl groups, preferably form a 5 or 6-membered, saturated nitrogen heterocycle which is unsubstituted, and in particular form an unsubstituted pyrrolidinium ring; and $R^3$ and $R^4$ together with the nitrogen atom they are bound to form a 5 or 6-membered, saturated nitrogen heterocycle which is unsubstituted or carries 1 or 2 methyl groups, preferably form a 5 or 6-membered, saturated nitrogen heterocycle which is unsubstituted, and in particular form an unsubstituted pyrrolidinium ring.

Examples of preferred quaternary ammonium hydroxides of the formula (I) according to the aformentioned groups of embodiments for use in the method of the present invention are selected from the group consisting of cyclopentyltrimethyl ammonium hydroxide, cyclohexyltrimethyl ammonium hydroxide, norbornyltrimethyl ammonium hydroxide, adamantyltrimethyl ammonium hydroxide, 5-azonia-spiro[4.4]nonane hydroxide, benzyltrimethyl ammonium hydroxide, diethyldimethylammonium hydroxide, ethyltrimethylammonium hydroxide, dimethyldi-n-propylammonium hydroxide, n-propyltrimethylammonium hydroxide, triethylmethylammonium hydroxide, tetramethylammonium hydroxide, diethyldi-n-propylammonium hydroxide, n-propyltriethylammonium hydroxide, dimethyldi-n-butylammonium hydroxide, n-butyltrimethylammonium hydroxide, n-butyltriethylammonium hydroxide, tetraethylammonium hydroxide, tetra-n-propylammonium hydroxide, tetra-n-butylammonium hydroxide, hexamethonium hydroxide and N,N-dimethylpyrrolidinium hydroxide; preferably selected from adamantyltrimethyl ammonium hydroxide, 5-azonia-spiro[4.4]nonane hydroxide, benzyltrimethyl ammonium hydroxide, diethyldimethylammonium hydroxide, ethyltrimethylammonium hydroxide, dimethyldi-n-propylammonium hydroxide, triethylmethylammonium hydroxide, tetramethylammonium hydroxide, tetraethylammonium hydroxide, tetra-n-propylammonium hydroxide, tetra-n-butylammonium hydroxide, hexamethonium hydroxide and N,N-dimethylpyrrolidinium hydroxide; and in particular selected from adamantyltrimethyl ammonium hydroxide, 5-azonia-spiro[4.4]nonane hydroxide, benzyltrimethyl ammonium hydroxide, diethyldimethylammonium hydroxide, ethyltrimethylammonium hydroxide, dimethyldi-n-propylammonium hydroxide, triethylmethylammonium hydroxide, tetraethylammonium hydroxide, tetra-n-propylammonium hydroxide, tetra-n-butylammonium hydroxide, hexamethonium hydroxide and N,N-dimethylpyrrolidinium hydroxide.

In a further preferred group of embodiments the variables $R^1$, $R^2$, $R^3$ and $R^4$ in the quaternary ammonium hydroxide of the formula (I) are defined as follows:

$R^1$, $R^2$, $R^3$ are each independently $C_1$-$C_6$-alkyl, preferably are each independently $C_1$-$C_4$-alkyl, and in particular are independently selected from methyl, ethyl, n-propyl and n-butyl;

$R^4$ is $C_1$-$C_{18}$-alkyl, preferably is $C_2$-$C_{18}$-alkyl, in particular is $C_2$-$C_4$-alkyl, and specifically is selected from ethyl, n-propyl and n-butyl;

or alternatively:

$R^3$ and $R^4$ together with the nitrogen atom they are bound to form a 5 or 6-membered, saturated nitrogen heterocycle which is unsubstituted or carries 1 or 2 methyl groups, preferably form a 5 or 6-membered, saturated nitrogen heterocycle which is unsubstituted, and in particular form an unsubstituted pyrrolidinium ring.

Examples of preferred quaternary ammonium hydroxides of the formula (I) according to this group of embodiments for use in the method of the present invention are selected from the group consisting of diethyldimethylammonium hydroxide, ethyltrimethylammonium hydroxide, dimethyldi-n-propylammonium hydroxide, n-propyltrimethylammonium hydroxide, triethylmethylammonium hydroxide, tetramethylammonium hydroxide, diethyldi-n-propylammonium hydroxide, n-propyltriethylammonium hydroxide, dimethyldi-n-butylammonium hydroxide, n-butyltrimethylammonium hydroxide, n-butyltriethylammonium hydroxide, tetraethylammonium hydroxide, tetra-n-propylammonium hydroxide, tetra-n-butylammonium hydroxide and N,N-dimethylpyrrolidinium hydroxide; and in particular selected from diethyldimethylammonium hydroxide, ethyltrimethylammonium hydroxide, dimethyldi-n-propylammonium hydroxide, triethylmethylammonium hydroxide, tetraethylammonium hydroxide, tetra-n-propylammonium hydroxide, tetra-n-butylammonium hydroxide and N,N-dimethylpyrrolidinium hydroxide.

In an especially preferred group of embodiments the variables $R^1$, $R^2$, $R^3$ and $R^4$ in the quaternary ammonium hydroxide of the formula (I) are defined as follows:

$R^1$, $R^2$, $R^3$ are each independently $C_1$-$C_6$ alkyl, preferably are each independently $C_1$-$C_4$-alkyl, and in particular are independently selected from methyl, ethyl, n-propyl and n-butyl; and $R^4$ is $C_2$-$C_6$ alkyl, in particular is $C_2$-$C_4$-alkyl, and specifically is selected from ethyl, n-propyl and n-butyl.

Examples of preferred quaternary ammonium hydroxides of the formula (I) according to this group of embodiments for use in the method of the present invention are selected from the group consisting of diethyldimethylammonium hydroxide, ethyltrimethylammonium hydroxide, dimethyldi-n-propylammonium hydroxide, n-propyltrimethylammonium hydroxide, triethylmethylammonium hydroxide, diethyldi-n-propylammonium hydroxide, n-propyltriethylammonium hydroxide, dimethyldin-butylammonium hydroxide, n-butyltrimethylammonium hydroxide, n-butyltriethylammonium hydroxide, tetraethylammonium hydroxide, tetra-n-propylammonium hydroxide and tetra-n-butylammonium hydroxide; in particular selected from diethyldimethylammonium hydroxide (DEDMAH), ethyltrimethylammonium hydroxide (ETMAH), dimethyldi-n-propylammonium hydroxide (DMDPAH), triethylmethylammonium hydroxide (TEMAH), tetraethylammonium hydroxide (TEAH), tetra-n-propylammonium hydroxide (TPAH) and tetra-n-butylammonium hydroxide (TBAH), and specifically selected from the group consisting of DEDMAH, TEMAH, TEAH, TPAH and TBAH.

Especially, the at least one quaternary ammonium hydroxide of the formula (I) is selected from the group consisting of DEDMAH, TEMAH, TEAH, TPAH and TBAH and mixtures thereof with most preference given to TEAH as well as mixtures of TEAH with one or more quaternary ammonium hydroxide of the formula (I), which is different from TEAH, in particular with one ore more of DEDMAH, TEMAH, TPAH and TBAH.

The present invention provides a method to reduce or prevent corrosion or fouling in an apparatus for carrying out a chemical process. Here, corrosion means the corrosive degeneration of metal components that are part of the apparatus and fouling means the accumulation and deposition of unwanted material on the interior surfaces of the apparatus. The corrosion and fouling are caused by acidic compounds which are present in the chemical process.

Here and in the following the phrase "acidic compounds present in the chemical process" refers to the following situations:

- the acidic compounds are already contained as such in the feedstock that is processed in the chemical process and thus introduced into the apparatus for carrying out the chemical process, and/or
- the acidic compounds are generated only in the course of the process.

To achieve reduction or prevention of corrosion or fouling the method comprises the addition of at least one quaternary ammonium hydroxide according of the formula (I), in particular at least one ammonium hydroxide of the formula (I) mentioned herein as preferred to the apparatus, wherein the chemical process is carried out.

Typically one ammonium hydroxide of the formula (I) or a mixture of two or more ammonium hydroxides (I) is added. If such mixtures are employed, preference is given to mixtures including two or more, especially two or three, of the ammonium hydroxides (I) mentioned herein as preferred, especially selected from TEAH, TPAH, TBAH, TEMAH and DEDMAH, and particular preference is given to mixtures consisting of TEAH and DEDMAH, TEAH and TEMAH or TEAH, DEDMAH and TEMAH. However, other mixtures of ammonium hydroxides of the formula (I) may be employed in the inventive method as well, for instance to adjust the properties of the salts that are obtained after the reaction of the ammonium hydroxides of the formula (I) with acidic compounds present within the treated apparatus, as discussed herein below.

In one group of embodiments of the present invention the at least one ammonium hydroxide (I) is introduced into the fluid or gaseous stream of the chemical process conducted within the apparatus. Here the ammonium hydroxide of the formula (I) is added as such or preferably in the form of a solution. The addition can be accomplished by metering the one or more ammonium hydroxides of the formula (I) to the feedstock entering the apparatus or by inserting them at certain locations of the apparatus that are often positioned upstream of the sections or units of the apparatus already affected or likely to be affected by corrosion or fouling.

By applying the method of the invention it is in principle possible to largely eliminate acidic compounds from chemical processes or to greatly prevent their formation during these processes, because the at least one quaternary ammonium hydroxide of the formula (I) used neutralizes such acidic compounds and converts them into the corresponding salts. These salts generally promote corrosion and fouling to a much lesser extent than the respective acidic compounds.

Examples of acidic compounds, which may cause corrosion and/or fouling in apparatuses for chemical processes include but are not limited to hydrogen halides, such as hydrogen chloride, hydrogen fluoride or hydrogen bromide, in particular hydrogen chloride, hydrogen sulfide, hydrogen cyanide, thiocyanic acid, sulfuric acid, $SO_2$, $SO_3$, nitrogen oxides, in particular NO and $NO_2$, carbonic acid, $CO_2$, organic acids, in particular carboxylic acids and sulfonic acids, acidic ammonium salts, acidic phosphorous compounds, and mixtures thereof. The aforementioned protonic acids as well as the protonic acids derived from the aforementioned oxides are known to mainly promote corrosive processes but may also contribute to fouling in chemical plants, while acidic ammonium salts are often involved in both corrosion and fouling. More specifically, hydrogen halides, hydrogen sulfide, hydrogen cyanide, thiocyanic acid, organic acids and acidic ammonium salts are corrosive species and foulants that are frequently found in crude oil refinery processes and petrochemical processes, such as in particular crude oil refining processes. Acidic phosphorous compounds may also be contained in crude oil grades, such as shale oils. Carbonic acid and $CO_2$ alongside with organic acids, on the other hand, are usually the main corrosive species in steam generating equipment, such as boiler systems used in chemical processes, while nitrogen oxides that are formed for instance in combustion processes cause corrosion problems mainly on the flue gas side of combustion equipment, such as diesel-powered engines.

The method of the present invention is particularly suitable for reducing or preventing corrosion caused by acidic compounds, which are selected from the group consisting of hydrogen chloride, hydrogen fluoride, $SO_3$, nitrogen oxides, acidic ammonium salts and acidic phosphorous compounds. The acidic ammonium compounds and the acidic phosphorous compounds may be either inorganic or organic compounds. Examples of acidic ammonium salts include, but are not limited to inorganic and organic ammonium halides, such as ammonium chloride and N-substituted ammonium chlorides, ammonium fluoride or ammonium bromide, in particular ammonium chloride, organic ammonium chlorides, e.g. di- and tri-$C_1$-$C_4$-alkylammonium chlorides such as trimethylammonium chloride or triethylammonium chloride, hydrochlorides of alkylene diamines, such as ethylenediamine monohydrochloride, hydrochlorides of alkanolamines, such as dimethylethanolammonium chloride, and hydrochlorides of alkoxyalkyl amines, such as 3-methoxylpropylammonium chloride, ammonium hydrogensulfide, ammonium sulfide, ammonium hydrogensulfate, ammonium sulfate and ammonium salts of carboxylic acids having 1 to 10 carbon atoms, such as ammonium formiate, ammonium acetate, ammonium propionate or ammonium butyrate, in particular ammonium acetate. Acidic phosphorous compounds include, but are not limited to phosphoric acid, polyphosphoric acid, acidic phosphates and acidic polyphosphates, phosphonic acid and acidic phosphonates. The polyphosphoric acid and acidic polyphosphates have at least 2, e.g. 2 to 1000 P atoms on average and may be linear, branched or cyclic. Examples of acidic phosphates include partial esters of phosphoric acid as well as mono- and dihydrogen phosphate salts of alkalimetals or of earth alkaline metals. Examples of acidic polyphosphates include acidic salts of polyphosphoric acid in particular acidic polyphosphate salts of alkalimetals or of earth alkaline metals.

Particularly relevant as corrosion or fouling causing acidic compounds are hydrogen chloride, hydrogen fluoride, sulfur trioxide, nitrogen oxides, ammonium chloride, organic ammonium chlorides, such as trimethylammonium chloride, triethylammonium chloride, ethylenediamine monohydrochloride, dimethylethanolammonium chloride and 3-methoxylpropylammonium chloride, ammonium sulfide, ammonium hydrogesulfide, ammonium sulfate and ammonium hydrogensulfate, and in particular hydrogen chloride, ammonium chloride and organic ammonium chlorides. The inventive method is particularly suited to combat the corrosive and fouling effects of these compounds in apparatuses for carrying out chemical processes.

The quaternary ammonium hydroxides of the formula (I) employed in the method of the present invention are well soluble in water and also in mixtures of water and a $C_1$-$C_4$-alkanol, such as methanol, ethanol, propanol or butanol. As the inventors of the present application found out, aqueous solutions of ammonium hydroxides (I), especially solutions with high concentrations of about 10 to 60% by weight or 20 to 40% by weight, are very stable during storage even at elevated temperatures of up to 50° C.

The term aqueous solutions is understood as a solution of the compound of the formula (I) in water or in mixtures of water with one or more water miscible organic solvents, such as mixtures of water and one or more $C_1$-$C_4$-alkanol, where water is the main constituent of the mixture of water and organic solvent, i.e. where the amount of water is at least 50% by weight, based on the total weight of the mixture of water and organic solvent.

Accordingly, unlike corresponding solutions of choline hydroxide, they feature high resistances to discoloration and smell development. In fact, the solutions of ammonium hydroxides of the formula (I) remain clear and colorless and have only a very weak smell after a prolonged storage at 40° C., whereas the choline hydroxide solution will turn yellow and develop a very strong fishy smell. Hence, aqueous solutions of ammonium hydroxides of the formula (I) have a higher storage stability than respective choline hydroxide solutions and, in particular, are well suited for long term storage even under adverse storage conditions.

A particular advantage associated with the present invention is the fact that the ammonium hydroxides of the formula (I) and their aqueous solutions have good stabilities at temperatures well above 200° C., i.e. the decomposition rate of the ammonium hydroxides of the formula (I) is low under these conditions. Therefore, ammonium hydroxides of the formula (I), in particular their aqueous solutions, can safely be introduced into process streams having a temperature up to 250° C., since the ammonium hydroxides of the formula (I) stay intact at such temperatures over a prolonged period of time and, thus, are able to effectively fight corrosion and fouling. Their stability at high temperatures is a very beneficial property of the aqueous solutions of ammonium hydroxides of the formula (I), because they can thus be injected at high temperature locations, such as e.g. feed/effluent heat exchangers in hydrodesulfurization plants, without significantly losing their effectiveness against corrosion and fouling. This is hardly or not possible with choline hydroxide and its solutions, which decompose very strongly already at temperatures above 200° C.

Additionally, due to their high stabilities, ammonium hydroxides of the formula (I) and their aqueous solutions can be introduced into process streams farther upstream than customary anti-corrosion and anti-fouling agents and thus enter hard-to-reach locations within apparatuses, such as process plants, that so far have hardly been accessible.

Moreover, ammonium hydroxides of the formula (I) are much stronger bases than ammonia and any organic amines. Their base strength is in fact equivalent or higher than that of choline hydroxide. This property allows for achieving high anti-corrosion and anti-fouling activity at lower molar dosages compared to methods of the prior art. Due to this very strong basicity ammonium hydroxides of the formula (I) also react readily with protonic acids like hydrogen chloride, hydrogen sulfide and organic acids to form the corresponding salts. The most relevant acid here is normally hydrogen chloride whose conversion with ammonium hydroxides of the formula (I) accordingly yields the quaternary ammonium chloride salts of the formula (II):

[Chem. 3]

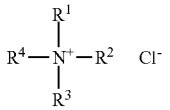

(II)

where the variables $R^1$, $R^2$, $R^3$ and $R^4$ have the same meanings, in particular the same preferred meanings, as defined in connection with formula (I).

Ammonium hydroxides of the formula (I) also readily react with acidic ammonium salts, such as in particular ammonium chloride, and organic ammonium salts to liberate ammonia or the respective amines and form quaternary ammonium salts, such as in particular the chlorides of formula (II). Thus, the inventors of the present application found that ammonium chloride is much more actively dissolved by diluted solutions of ammonium hydroxides of the formula (I) than by those of choline hydroxide. In conclusion, ammonium hydroxides of the formula (I) are well suitable for the neutralization of corrosion inducing protonic acids as well as for the dissolution of acidic ammonium salts in fouled systems and for the prevention of such fouling salt deposits.

The suitability of the ammonium hydroxides of the formula (I) for controlling corrosion and fouling in chemical plants also depends on the physiochemical properties of the salts they form when reacting with acidic compounds particularly selected from protonic acids and acidic ammonium salts. Here the melting and decomposition points of these salts derived from ammonium hydroxides of the formula (I) are of particular interest as they strongly influence the fate of said salts which are situated in certain locations within a plant that has been treated with an ammonium hydroxide (I) in accordance of the method of the present invention. More specifically, the melting point determines the temperature at which the salts significantly improve their flow behavior, while the decomposition point defines the temperature at which potentially troublesome degradation products are formed. As it turned out, in particular the chlorides derived from the ammonium hydroxides of the formula (I), i.e. the salts of formula (II), in many cases have melting points below 80° C. and decomposition points above 200 or even above 250° C. Thus, their melting points are often much lower than that of choline chloride and their decomposition points exceed the temperatures prevailing in most units of chemical plants. For these reasons, the use of ammonium hydroxides of the formula (I) is advantageous as, for one, the salts formed by their reaction with acidic compounds are flowable already at low temperatures and thus can be easily transported and removed from the plant unit treated with an ammonium hydroxide of the formula (I). In addition, due to their very high decomposition points the formed salts survive high process temperatures without undergoing degradation and are readily removed from process units in the form of aqueous solutions. Indeed, owing to the very good water solubilities of the salts, even very small amounts of liquid water or steam present in the treated process stream will suffice to facilitate their removal.

From the foregoing it is apparent that not only the ammonium hydroxides of the formula (I) used for the treatment according to the inventive method, but also the salts to which they are converted by the reaction with the acidic compounds present in the chemical process, have very high decomposition points. Therefore, the process stream within the apparatus in which the process is carried out may be heated to high temperatures without the risk that the ammonium hydroxides of the formula (I) or the salts formed therefrom are degraded. Accordingly, the fluid or gaseous stream of the chemical process can be subjected to a temperature of at least 100° C., frequently at least 150° C., in particular at least 180° C., especially at least 200° C. or at least 250° C. during or after the addition of the ammonium hydroxide (I) to the stream.

In addition, the salts derived from ammonium hydroxides (I), in particular the chloride salts of formula (II), are generally not only highly water-soluble but are typically also hygroscopic, although the degree of hygroscopicity varies between different salts (II). Due to their hygroscopicity the salts derived from ammonium hydroxides (I), such as salts (II), readily absorb minimal quantities of moisture present in treated process streams, so that flowable solutions are formed. This facilitates the easy removal of the salts from the streams through aqueous solutions that are drained from various process units, such as for example vapor-liquid separators and oil-water separators. Consequently, by applying an ammonium hydroxide (I) according to the inventive method deposits comprising salts causing corrosion or fouling, such as ammonium chloride and organic ammonium chlorides, can be effectively removed from the treated systems.

Moreover, the addition of even small amounts of strongly hygroscopic chloride salts of formula (II) can significantly increase the hygroscopicity of weakly hygroscopic chloride salts (II), as experiments by the inventors of the present application have shown. This is also true for salts derived from ammonium hydroxides of formula (I), other than chlorides. Hence, the blending of two or more different ammonium hydroxides of the formula (I) at a specific, easily identifiable ratios allows the formation of a salt mixture after treatment whose hygroscopicity is adjusted and fine-tuned to special requirements of "wet" or "dry" systems, i.e. systems having relatively high or low water contents. An example of a wet system is the overhead section of a distillation column employing stripping steam, such as an atmospheric distillation column. An example of a dry system is the feed/effluent heat exchanger in a gasoline hydrodesulfurization unit. Accordingly, one group of embodiments of the present invention relates to the inventive method employing a mixture of ammonium hydroxides (I) which are preferably in a certain ratio to each other. Preference is given in this context to mixtures resulting in the formation of mixtures of salts (II) that have certain sought after physiochemical properties, for instance an optimized hygroscopicity.

The salts of formula (II), and also salts derived from ammonium hydroxides (I), other than chlorides (II), i.e. compounds of the formula (IIa)

[Chem. 4]

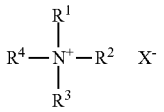

(IIa)

where X is a non-basic and non-acidic counter ion, such as bromide, sulfate or nitrate, have near neutral pH values when dissolved in water, which makes them much less corrosive compared to ammonium chloride and chloride salts formed from amines conventionally used for neutralizing corrosion-contributing acidic compounds, such as e.g. monoethanolamine (MEA). Thus, due to their very low corrosivity, salts derived from ammonium hydroxides (I), such as especially salts of formulae (II) and (IIa), which will form upon treating a chemical process unit with ammonium hydroxides of the formula (I) in accordance to the method of the present invention, have hardly any adverse effect on the metal surfaces within the unit. These salts would therefore not cause significant corrosion damages even if remaining in a process unit for a long time, although they are usually removed already by traces of water or steam present in the process stream, as discussed above. In conclusion, the use of ammonium hydroxides of the formula (I) as an anti-corrosion and anti-fouling agent has the further benefit that secondary corrosion that is often caused by salts originating from the reaction of conventional agents with acidic compounds, is greatly reduced.

As outlined above, the salts generated by the conversion of ammonium hydroxides of the formula (I) with acidic compounds, in particular the salts of formula (II), not only have very high decomposition points but also are readily removable from chemical process streams. However, in the rare event that such a salt is nevertheless exposed to a temperature equal to or higher than its decomposition point, it decomposes into noncritical compounds. Thus, the inventors of the present application could demonstrate that the pyrolysis of different salts of the formula (II) in all cases resulted in the corresponding alkylchlorides and trialkylamines as the main decomposition products. For instance, tetraethylammoniumchloride (TEA-Cl) predominantly decomposes into ethylchloride and triethylamine, and diethyldimethylammonium chloride (DEDMA-Cl) into methylchloride, ethylchloride, diethylmethylamine and ethyldimethylamine. The formed alkylchlorides are removed from the process via gas streams leaving e.g. separators, columns or heat exchangers and hence have no negative impact on the process or the apparatus in which the process is carried out. The formed trialkylamines, on the other hand, may function as further bases for neutralizing corrosive acidic compounds and are then removed from the system as ammonium salts. It is important to note that during the thermal decomposition of the salts of formula (II) virtually no corrosive hydrogen chloride is formed. According to this thermal decomposition pathway of the salts (II) any chlorides stemming from corrosive or fouling species such as hydrogen chloride or ammoniumchloride are safely and permanently removed from the process plant in the form of alkylchlorides.

In one group of embodiments of the present invention the at least one quaternary ammonium hydroxide of the formula (I) is added into the chemical process as a solution of one or more ammonium hydroxides (I). Such solutions are preferably prepared by dissolving the at least one ammonium hydroxide (I) in a solvent selected from water, $C_1$-$C_4$-alkanols, such as methanol, ethanol, n-propanol, isopropanol, n-butanol, sec-butanol or isobutanol, and mixtures thereof. Preferred solvents here are water, ethanol, n-propanol, isopropanol, n-butanol, isobutanol and sec-butanol and mixtures thereof, such as mixtures of water with ethanol, propanol, isopropanol, n-butanol, isobutanol or sec-butanol. The total concentration of the at least one ammonium hydroxide (I) in these solutions is frequently in the range from 10 to 60% by weight, preferably in the range from 10 to 50% by weight and in particular in the range from 10 to 40% by weight.

The solutions of at least one ammonium hydroxide of the formula (I) for use in the method of the present invention for reducing or preventing corrosion or fouling optionally further contain one or more additives that are for example selected from dispersants, such as e.g. polyisobutylene succinimides, antioxidants/antipolymerizing agents, such as e.g. tert-butylphenol derivatives, phenylenediamines, N-oxyl compounds, such as 2,2,6,6-tetramethyl-piperidine-N-oxyl (TEMPO) and derivatives of TEMPO such as 4-hydroxy-2,2,6,6-tetramethyl-piperidine-N-oxyl (4-OH-TEMPO) and antifoams, such as e.g. copolymers of ethylene oxide and propylene oxide, polypropyleneglycol or silicon oils. The solutions may optionally also contain additional actives including for instance further anti-corrosion and anti-fouling agents, such as choline hydroxide, and neutralizing amines, such as alkylamines or alkanolamines.

Moreover, the solutions of the at least one ammonium hydroxide of the formula (I) may optionally also include actives that are not associated with controlling corrosion or fouling but have a markedly different function. An example of such an active is 4-tert-butylcatechol (TBC) which is a polymerization inhibitor and is thus suitable as stabilizer of monomers. Solutions according to the present invention that comprise TBC and at least one ammonium hydroxide of the formula (I) are useful for antifoulant applications in process plants or units thereof that contain monomers, such as process water systems of ethylene plants. The combination of quaternary ammonium hydroxide of the formula (I) and TBC has the surprising additional benefit that due to their strong basicity ammonium hydroxides of the formula (I) facilitate the dissolution of the weakly acidic TBC in water. Hence, other, potentially harmful auxiliaries for dissolving TBC are not required for preparing bifunctional formulations containing both ammonium hydroxide of the formula (I) and TBC.

The at least one ammonium hydroxide of the formula (I) can be introduced into the chemical process at one or more locations of an apparatus in which a chemical process is carried out, for example at different units of a process plant. Preferably, the ammonium hydroxides (I) are introduced into the process by injecting of solution thereof at one or more locations or into one or more units of the apparatus or process plant. The injection is typically performed by a continuous injection method, such as quantified injection or flow rate proportional injection, or, alternatively by an intermittent injection method, such as suction injection or forced injection.

The at least one ammonium hydroxide of the formula (I) is usually introduced into the fluid stream of a chemical process in an amount in the range of 1 to 5000 ppm, in particular in the range of 1 to 2500 ppm more preferably in the range of 1 to 1000 ppm, especially in the range of 1 to 500 ppm, based in each case on the amount of the fluid or stream of the chemical process in each location the addition takes place. It is particularly preferred to adjust the added amount of ammonium hydroxide of the formula (I) to the quantity of corrosive species and/or foulants, such as in particular the quantity of protonic acids and/or acidic ammonium salts, in the fluid stream to be treated. This way ammonium hydroxide of the formula (I) is only added in an amount required for instance to neutralize a corrosive acid, such as hydrogen chloride, contained in the stream, or to dissolve deposits comprising ammonium chloride in a process unit. It is for example useful in some cases to measure the pH value or the chloride concentration in a suitable part of a process unit and determine the quantity of ammonium hydroxide of the formula (I) to be added on the basis of the measured values. Alternatively, in other cases it may be sufficient to add to an established process a certain amount of ammonium hydroxide of the formula (I) that experience has shown to be appropriate. In both of the above examples the addition of ammonium hydroxide of the formula (I) is preferably accomplished by injecting a solution of ammonium hydroxide of the formula (I) either continuously or intermittently to one or more locations of the plant.

According to preferred groups of embodiments of the method of the invention the chemical process is a crude oil processing, such as a crude oil refinery process and/or a petrochemical process, such as in particular a crude oil refinery process or a petrochemical process. In this context the crude oil refinery process typically includes one or more process units selected from the crude oil atmospheric distillation unit, the crude oil vacuum distillation unit, the visbreaker unit, the delayed coker unit, the fluidized catalytic cracking unit, the reformer unit, the hydrocracker unit, the alkanolamine unit, the sulfinol unit and the hydrodesulfurization unit.

The crude oil distillation unit (CDU), also called crude oil atmospheric distillation unit, is generally the first processing unit of virtually all oil refineries. In a CDU the incoming crude oil is distilled into various fractions of different boiling ranges, each of which may then be processed further in the other refinery processing units. The distillation in a CDU is usually conducted at slightly above atmospheric pressure. A CDU commonly comprises as major components heat exchangers, a desalter, a furnace and a distillation column mounted in series, and also a side stripper and a reflux drum. A first preferred dosing point, i.e. a location where one or more ammonium hydroxides (I), or preferably a solution thereof, may beneficially be added into the CDU, is the pipe leaving the desalter. The introduction of the ammonium hydroxide of the formula (I) at this location serves as partial or full replacement of sodium hydroxide, which is often used to remove calcium chloride and magnesium chloride from the crude oil leaving the desalter, by converting them into their corresponding hydroxides. If the calcium and magnesium chlorides remained in the crude oil, they would undergo hydrolysis in the furnace producing hydrogen chloride gas that would dissolve in condensed water, e.g. in the overhead section of the distillation column, and thus lead to corrosion. However, the use of sodium hydroxide is associated with drawbacks, one of which is that sodium salts may poison the catalysts used in subsequent processing units, such as the hydrodesulfurization or catalytic cracking units. These drawbacks can be avoided or mitigated by fully or partially replacing sodium hydroxide with an ammonium hydroxide of the formula (I), in particular because ammonium hydroxide of the formula (I) is also a strong base but does not include sodium.

Further preferred dosing points where one or more ammonium hydroxides (I), preferably a solution thereof, may beneficially be introduced into the CDU, are the overhead section and the distillation column as well as their attached connecting pipes, condensers, heat exchangers, receiving tanks and other components. Introduction of ammonium hydroxides of the formula (I) at these locations serves to combat corrosion and salt fouling.

In a crude oil vacuum distillation unit (VDU) generally the high-boiling bottom fraction from the atmospheric distillation is fractionized by subjecting it to a vacuum distillation. The main component of a VDU is a distillation column. Preferred dosing points where one or more ammonium hydroxides of the formula (I), preferably a solution thereof, may beneficially be introduced into the VDU, are the overhead section and the distillation column as well as their attached connecting pipes, condensers, heat exchangers, receiving tanks and other components. Introduction of ammonium hydroxides of the formula (I) at these locations serves to combat corrosion and salt fouling.

In a visbreaking unit, also termed Visbreaker, the residue from vacuum distillation is thermally cracked into lighter components of higher value. The main components of a Visbreaker are feed/effluent heat exchangers, a furnace, a residence vessel (soaker) and a distillation column or series of distillation columns. Preferred dosing points where one or more ammonium hydroxides of the formula (I), preferably a solution thereof, may beneficially be introduced into the Visbreaker, are the overhead section and the distillation column as well as their attached connecting pipes, condensers, heat exchangers, receiving tanks and other components. Introduction of ammonium hydroxides of the formula (I) at these locations serves to combat corrosion and salt fouling.

The fluidized catalytic cracking unit (FCC) uses a solid acidic catalyst, such as zeolites, in particular to break down the high boiling residues from the distillation of crude oil into various lower boiling fractions. A FCC commonly comprises a first division that includes a reactor and a regenerator and a second division that principally resembles a CDU unit. Preferred dosing points where one or more ammonium hydroxides of the formula (I), preferably a solution thereof, may beneficially be introduced are mainly located in the second division of the FCC, such as the overhead section and the distillation column as well as their attached connecting pipes, condensers, heat exchangers, receiving tanks and other components. Introduction of ammonium hydroxides of the formula (I) at these locations serves to combat corrosion and salt fouling.

In a delayed coker unit, residues from vacuum distillation are converted to petroleum coke and lighter fractions by thermal pyrolysis. A delayed coker unit mainly comprises feed/effluent heat exchangers, a furnace, a fractionation column and several coke drums. Preferred dosing points where one or more ammonium hydroxides of the formula (I), preferably a solution thereof, may beneficially be introduced into the delayed coker unit, are the overhead section and the distillation column as well as their attached connecting pipes, condensers, heat exchangers, receiving tanks and other components. Introduction of ammonium hydroxides of the formula (I) at these locations serves to combat corrosion and salt fouling.

The reformer unit uses a catalytic process for the conversion of typically the naphtha fraction from crude oil distillation, which contains relatively low-boiling hydrocarbons having low octane ratings, into a high-octane reformate including branched alkanes and aromatic hydrocarbons. A reformer unit commonly comprises as major components a feed/effluent heat exchanger, a furnace, a series of reactors, a gas separator, a stabilizer and a reflux drum. Preferred dosing points where one or more ammonium hydroxides of the formula (I), preferably a solution thereof, may beneficially be introduced into the reformer unit, are the feed/effluent heat exchanger, the recycle gas lines leaving the gas separator, the intermediate reformate pipelines between gas separator and stabilizer, and the overhead section of the stabilizer as well as attached connecting pipes, condensers, heat exchangers, receiving tanks and other components.

The hydrocracker unit uses a catalytic cracking process in the presence of hydrogen gas to produce predominantly saturated hydrocarbons from oil distillation fractions having higher molecular weight. A hydrocracker unit commonly comprises as major components usually two reactors, furnaces, feed/effluent heat exchangers and a distillation subunit which in principle resembles a CDU unit. Preferred dosing points where one or more ammonium hydroxides of the formula (I), or preferably a solution thereof, may beneficially be introduced into the hydrocracker unit, are the feed/effluent heat exchangers, and the overhead section of the distillation column as well as attached connecting pipes, condensers, heat exchangers, receiving tanks and other components.

In the hydrodesulfurization unit (HDS) mineral oil products are desulfurized via catalytic hydrogenation. A HDS commonly comprises as major components a feed/effluent heat exchanger, a furnace, a fixed-bed reactor, a gas separator, a stripper and a reflux drum. Preferred dosing points where one or more ammonium hydroxides of the formula (I), or preferably a solution thereof, may beneficially be introduced into the HDS, are the feed/effluent heat exchanger and the overhead section of the stripper as well as attached connecting pipes, condensers, heat exchangers, receiving tanks and other components.

Alkanolamine and sulfinol units are gas washing plants in which acidic components like $CO_2$ and $H_2S$ are removed from useful gas streams like natural gas and refinery fuel gas. Alkanolamine and sulfinol units are commonly referred to as acidic gas washing units. Such units mainly comprise an absorber column, a "lean/rich" heat exchanger, a regeneration column, a reflux drum and connected pipings. A solvent solution typically comprising an amine solution circulates through the plant. Acid gases are absorbed into the solvent solution inside the absorber column at low temperature and high pressure and subsequently released in the regenerator column at high temperature and low pressure. Heat exchange is performed between the loaded (rich) and unloaded (lean) solution as the solvent flows back and forth between the columns. The purified gas is obtained at the top of the absorber column while acid gases are withdrawn at the top of the regenerator column. Preferred dosing points where one or more ammonium hydroxides of the formula (I), or preferably a solution thereof, may beneficially be introduced into acidic gas washing units, are the rich/lean heat exchangers, the overhead section of the regenerator, the absorber and regenerator columns as well as attached connecting pipes, condensers, heat exchangers, receiving tanks and other components.

According to another preferred embodiment of the method of the invention the chemical process carried out in an apparatus to which the at least one ammonium hydroxide of the formula (I) is added, is a steam generating process. An apparatus for carrying out such a process is any unit capable of generating steam, such as a general boiler, a heat recovery steam generator, e.g. a heat recovery steam generator of a petrochemical plant, also called waste heat boiler, a dilution steam generator in an ethylene plant, a boiler of a steam turbine, a boiler of a pressurized water reactor and the like. There are many variants of boilers or steam generators, like cylindrical boilers, water tube boilers, once-through boilers, cast-iron boilers and special boilers, such as for instance indirect heating boilers, waste heat boilers or special fuel boilers. Generally, all interior surfaces of boilers getting into contact with steam or water are prone to corrosion, in particular if acidic components are present in the boiler's aqueous system. Thus, measures for reducing or preventing corrosion in boilers are of great importance.

Corrosion within boilers and steam generators can be beneficially prevented by adding the at least one quaternary ammonium hydroxide of the formula (I), or preferably a solution thereof, to their aqueous system. Ammonium hydroxides of the formula (I) neutralize acids and other acidic compounds present in the water or the aqueous solution within a boiler, and are thus capable to maintain a pH value that is sufficiently high to completely or at least largely prevent corrosion. Generally, the ammonium hydroxides (I) can be added to or injected into any part of the boiler's interior, such as in particular one of the usually three water systems of the boiler, i.e. the feed water system, the water system inside the boiler and the vapor/condensed water system. However, since neutralization is more widespread if the at least one ammonium hydroxide (I) is added further upstream, it is in general preferred to add it to the feed water system.

Further aspects of the present invention relate to the uses of the quaternary ammonium hydroxides of the formula (I) defined herein, especially the ones defined herein as preferred, for reducing or preventing corrosion or fouling in an apparatus for carrying out a chemical process, where corrosion or fouling is caused by acidic compounds present in the chemical process. Such uses of the quaternary ammonium hydroxides of the formula (I) in any of the inventive methods described herein are preferred.

The following examples serve as further illustration of the invention.

EXAMPLES

Abbreviations

ASNH 5-azoniaspiro[4.4]-nonane hydroxide
ATMAH adamantyltrimethylammonium hydroxide
BTMAH benzyltrimethylammonium hydroxide
choline hydroxide N,N,N-trimethyl-N-(2-hydroxyethyl) ammonium hydroxide
DEDMAH diethyldimethylammonium hydroxide
DMDPAH dimethyldi-n-propylammonium hydroxide
DMPH 1,1-dimethylpyrrolidinium hydroxide
DSC dynamic scanning calorimetry
ETMAH ethyltrimethylammonium hydroxide
HMH hexamethonium hydroxide
MEA monoethanolamine (2-aminoethanol)
n.d. not determined
TBAH tetra-n-butylammonium hydroxide
TEAH tetraethylammonium hydroxide
TEMAH triethylmethylammonium hydroxide
TGA thermogravimetric analysis
TPAH tetra-n-propylammonium hydroxide
wt. % % by weight Analytical Methods:

i. Ion Chromatography:

Column Metrosep C4-250/4.0—Silica based weak cation-exchange material, 5 μm in diameter. Substrate is surface polymerized polybutadienemaleic acid to provide carboxylic acid functionalities. Capacity not less than 29 μEq/column Pre Column Metrosep C4 Guard Autosampler 863 Compact Autosampler Temperature 20-25° C.

Detection Conductivity @40° C.

Flow 0.9 ml/min

Eluent 0.7 mmol/l dipicolinic acid, 1.7 mmol/l $HNO_3$, 0.05 mmol/l 18-Crown-6, 1% Acetone; balance: ultrapure water Injection Volume 20 μl Duration 40 min typical Conductivity 635±5 μS System Pressure 12.5±0.5 MPa ii. TGA:

TGA was carried out using the TGA equipment TA Instruments TGA Q 5000. The measurement parameters were as follows:

heating rate: 10 K/min sample weight: 6-7 mg purge gas: 31 l/h $N_2$ sample vessel: Al-crucible, open one heating run from room temperature to 600° C.

iii. DSC

DSC was carried out using the DSC equipment TA Instruments pDSC Q20. The measurement parameters were as follows:

heating rate: 10 K/min cooling rate: manual sample weight: 6-8 mg purge gas: 3 l/h $N_2$ sample vessel: Al-crucible, open first heating run: ca. −30° C. to 200-400° C. (depending on sample)

first cooling run: 200° C.-400° C. to ca. −30° C.

second heating run: ca. −30° C. to 200-400° C. (depending on sample)

Example 1

Storage Stability of Aqueous Solutions of the Quaternary Ammonium Hydroxides of Formula (I)

The commercially available aqueous solutions of ammonium hydroxides (I) specified in table 1 were filled into small glass vials, stored for 2 months at 5° C., 20° C. and 40° C., respectively, and periodically checked by visual examination. A concentrated choline hydroxide solution was used as reference. The results are given in table 1.

TABLE 1

Storage stability of aqueous solutions of ammonium hydroxides (I)

| Compound, Concentration [wt. %] | 5° C. | 20° C. | 40° C. |
|---|---|---|---|
| choline hydroxide, 45 wt. % | clear, colorless solution | clear, colorless solution | clear, yellow solution |
| TEAH, 35 wt. % | clear, colorless solution | clear, colorless solution | clear, colorless solution |
| TPAH, 40 wt. % | clear, colorless solution | clear, colorless solution | clear, colorless solution |
| TBAH 40, wt. % | solidification | clear, colorless solution | clear, colorless solution |
| DEDMAH, 20 wt. % | clear, colorless solution | clear, colorless solution | clear, colorless solution |
| TEMAH, 20 wt. % | clear, colorless solution | clear, colorless solution | clear, colorless solution |
| HMH, 2.4 wt. % | clear, colorless solution | clear, colorless solution | clear, colorless solution |
| BTMAH, 40 wt. % | clear, colorless solution | clear, colorless solution | clear, colorless solution |
| ASNH, 25 wt. % | clear, colorless solution | clear, colorless solution | clear, colorless solution |
| DMPH, 25 wt. % | clear, colorless solution | clear, colorless solution | clear, colorless solution |

As can be seen from table 1, the solution of choline hydroxide after being subjected to 40° C. storage became yellow over time. It also developed a distinct fishy smell. In contrast, the aqueous solutions of the tested ammonium hydroxides (I) remained clear and colorless and did not develop strong smell. Mixed solutions of these ammonium hydroxides (I) yielded similar results.

Example 2

Thermal Stabilities of Quaternary Ammonium Hydroxides of the Formula (I)

Solutions of several ammonium hydroxides (I) in deionized water at a concentration of 100 ppm (by weight) were prepared and filled into stainless steel autoclaves, which were subsequently purged with nitrogen and heated at a temperature of 220° C. for 4 hours, and then cooled to room temperature. The solutions were analyzed before and after the thermal treatment using ion chromatography by the method described above. Choline hydroxide was used as reference. The averaged results of duplicate experiments are shown in table 2. The stability percentages given in table 2 correspond to the measured remaining amounts of the ammonium hydroxides of the formula (I).

TABLE 3

Thermal stability of aqueous solutions of ammonium hydroxides (I) over 1 hour at 240° C.

| compound | stability (%) |
|---|---|
| choline hydroxide | 6 |
| TEAH | 50 |
| TPAH | 83 |
| TBAH | 92 |
| DEDMAH | 50 |

The experiments on thermal stability described above were repeated at a temperature of 240° C. over a period of 1 hour. The average results of duplicate experiments are shown in table 3. The stability percentages given in table 3 correspond to the measured remaining amounts of the ammonium hydroxides (I).

TABLE 2

Thermal stability of aqueous solutions of ammonium hydroxides (I) over 4 hours at 220° C.

| compound | stability (%) |
|---|---|
| choline hydroxide | 24 |
| TEAH | 63 |
| TPAH | 90 |
| TBAH | 90 |
| DEDMAH | 65 |
| TEMAH | 65 |
| BTMAH | 85 |

It is apparent from tables 2 and 3 that the thermal stability of diluted aqueous solutions of the ammonium hydroxides (I) is significantly higher than that of a corresponding choline hydroxide solution.

Example 3 pH Values of Aqueous Solutions of the Quaternary Ammonium Hydroxides of the Formula (I)

Ammonium hydroxides (I) were dissolved in deionized water at a concentration of 8.25 mmol/l and the pH values of these solutions were measured using a calibrated pH electrode. For comparison the pH values of corresponding solutions of ammonia, MEA and choline hydroxide were also measured. The results are given in table 4.

TABLE 4 pH values of aqueous solutions of amines and quaternary ammonium hydroxides

| compound | pH value |
|---|---|
| ammonia | 10.1 |
| MEA | 10.4 |
| choline hydroxide | 11.3 |
| TEAH | 11.9 |
| TPAH | 11.9 |
| TBAH | 11.8 |
| DEDMAH | 11.8 |
| TEMAH | 11.7 |
| HMH | 12.1 |
| BTMAH | 11.8 |
| ASNH | 11.6 |
| DMPH | 11.6 |
| DMDPAH | 11.6 |
| ETMAH | 11.6 |
| ATMAH | 11.6 |

The results summarized in table 4 show that the solutions of the tested ammonium hydroxides of formula (I) are much more alkaline (by a factor of about 10 to 100) than those of ammonia and MEA and that their basicity is equivalent or higher compared to choline hydroxide.

Example 4

Dissolution of the Ammonium Chloride in Diluted Aqueous Solutions of Quaternary Ammonium Hydroxides of Formula (I)

Ammonium chloride (0.1 g) was placed on a watch glass and in each case a 1 wt. % aqueous solution of a ammonium hydroxide (I) was added dropwise using a plastic pipette, until ammonium chloride was completely dissolved. A 1 wt. % solution of choline hydroxide was used as reference. The results are summarized in table 5 as number of drops necessary to completely dissolve the salt.

TABLE 5

Dissolution of ammonium chloride

| compound | number of drops |
|---|---|
| choline hydroxide | 18 |
| TEAH | 10 |
| TPAH | 13 |
| TBAH | 10 |
| DEDMAH | 9 |
| TEMAH | 10 |

All tested solutions were capable of dissolving ammonium chloride accompanied by the development of ammonia gas. However, significant lower volumes of the solutions of the ammonium hydroxides (I) were required for complete dissolution compared to the amount of choline hydroxide solution required for complete dissolution.

Example 5

Melting Points and Decomposition Points of the Chloride Salts Formed from Quaternary Ammonium Hydroxides of Formula (I)

The melting points and decomposition points of the chlorides derived from ammonium hydroxides (I) as well as of some comparable chlorides were measured using DSC and TGA as described above. The obtained results are summarized in Table 6. As indicated, some values have been taken from the literature.

TABLE 6

Thermal properties of ammonium chlorides

| chloride salt | melting point (° C.) | decomposition point (° C.) |
|---|---|---|
| ammonium chloride | — | 338 (sublimation/decomposition) [3]; DSC: 275 |
| monoethanolammonium chloride | 82-86 [4] DSC: 84 | DSC: 200 |
| choline chloride | — | 305 (melting/decomposition) [5]; DSC: 320 |
| TEA-Cl | 110 [1], [2]; DSC: 123 | 240-270 [1], [2]; DSC: 280 |
| TPA-Cl | 113 [1], [2]; DSC: 77 | 190-215 [1], [2]; DSC: 240 |
| TBA-Cl | 50-113 [1], [2]; DSC: 77 | 180 [1], [2]; DSC: 210 |
| DEDMA-Cl | 108 [1], [2]; DSC: 72 | DSC: 290 |
| TEMA-Cl | DSC: 50 | DSC: 290 |
| HM-Cl | 290 [1], [2] | n.d. |
| BTMA-Cl | 243 [1], [2] | n.d. |

[1] N. Collie et al.; The action of heat on the chlorides and hydroxides of mixed quaternary ammonium compounds; Journal of the Chemical Society, Transactions, Volume 57 (1890), 767-782
[2] J. Blazejowski et al.; Thermal decomposition of alkylammonium chlorides; Thermochimica Acta, 92 (1985), 811-814
[3] "International Chemical Safety Cards" data were obtained from the National Institute for Occupational Safety and Health (US) (via Scifinder, Chemical Abstract Service, CAS, USA)
[4] Wystrach, V. P.; Journal of the American Chemical Society 1955, V77, P5915-18
[5] "PhysProp" data were obtained from Syracuse Research Corporation of Syracuse, New York (US); (via Scifinder, Chemical Abstract Service, CAS, USA)

As evident from table 6, the chloride salts derived from quaternary ammonium hydroxides of formula (I), in particular those derived from TEAH, TPAH, TBAH, DEDMAH and TEMAH, have rather low melting points compared to the melting points of ammonium chloride and choline chloride. It can also be seen that the chloride salts derived from ammonium hydroxides of the formula (I) decompose only at high temperatures.

Example 6

Hygroscopicity of Chloride Salts Formed from Quaternary Ammonium Hydroxides of Formula (I)

Chloride salts derived from ammonium hydroxides (I) were prepared by carefully neutralizing 5 w % hydrochloric acid solutions with eqimolar quantities of the ammonium hydroxides of formula (I) to a slightly acidic pH (pH 5.5-6.5), removing the water using a rotary evaporator (15 mbar absolute pressure, 80° C.), taking up the obtained crude salt in isopropanol and evaporating the solvent in a clean flask using the rotary evaporator. For high precision analytical studies such as pH value and corrosion studies, some salts were purified in several steps by using the isopropanol washing steps subsequently several times.

The thus prepared, dried chloride salts of the corresponding ammonium hydroxides (I) were put onto watch glasses, stored openly in the ambient laboratory air having a relative humidity of 50% and observed during a period of 24 hours. The degree of dissolution of the salts were evaluated. Ammonium chloride, MEA-Cl (monoethanolammonium chloride) and choline chloride were used as references.

The hygroscopicity of the salts was assessed according to the following scale:

1 extremely hygroscopic: dissolution in less than 10 minutes;

2 strongly hygroscopic: dissolution in less than 1 hour;

3 medium hygroscopicity: dissolution in 1 to 6 hours;

4 weakly hygroscopic; dissolution in 6 to 24 hours;

5 non hygroscopic: no visible change in 24 hours.

The results are summarized in table 7.

TABLE 7

Hygroscopicity of chloride salts

| compound | hygroscopicity |
|---|---|
| ammonium chloride | 5 |
| MEA-Cl | 3 |
| choline chloride | 1 |
| TEA-Cl | 4 |
| TPA-Cl | 2 |
| TBA-Cl | 4 |
| DEDMA-Cl | 1 |
| TEMA-Cl | 1 |
| HM-Cl | 3 |
| BTMA-Cl | 3 |

It can be seen from the data summarized in table 7 that hygroscopicity of the chloride salts derived from ammonium hydroxides (I) ranges from weak to extremely strong. Accordingly, these chloride salts absorb ambient moisture and thus will convert into flowable solutions in the presence of moisture. Further test series were conducted using salt mixtures consisting of TEA-Cl, i.e. a weakly hygroscopic salt, and either choline chloride, DEDMA-Cl, TEMA-Cl or TPA-Cl, i.e. a very hygroscopic salt, in a weight ratio of 9:1. These mixtures showed high hygroscopicity in comparison for example to that of TEA-Cl alone.

Further experiments conducted using the chloride salts (II) in gasoline spiked with ppm quantities of water showed the ability of the salts to absorb moisture even from non polar hydrocarbon fluids.

Example 7 pH Values of Chloride Salt Solutions Derived from Quaternary Ammonium Hydroxides of Formula (I)

Purified chloride salts derived from ammonium hydroxides (I) were dissolved in deionized water at a concentration of 10 wt. % and the pH values of these solutions were measured using a calibrated pH electrode. Ammonium chloride, MEA-Cl and choline chloride were used as references. The results are given in table 8.

TABLE 8 pH values of aqueous solutions of ammonium chloride salts

| compound | pH |
|---|---|
| ammonium chloride | 4.8 |
| monoethanolammonium chloride | 6.4 |
| choline chloride | 6.0 |
| TEA-Cl | 6.7 |
| TPA-Cl | 6.6 |
| TEMA-Cl | 6.8 |
| BTMA-Cl | 7.5 |

The results summarized in table 8 show that the aqueous solutions of the chloride salts derived from ammonium hydroxides (I) do not have acidic but about neutral pH values.

Example 8

Corrosivity of Chloride Salts Derived from Quaternary Ammonium Hydroxides of Formula (I)

Test tubes (volume: 15 ml) were filled with 30 wt. % aqueous solutions of purified chloride salts derived from ammonium hydroxides (I). A pre-weighed carbon steel coupon was placed in each of the tubes, which were semi-closed, to allow hydrogen gas from corrosion to escape, and vertically immersed for 24 hours in an oil bath having a temperature of 70° C. The coupons were taken out of the solutions, any corrosion products were removed from their surfaces by careful treatment with 10 w % hydrochloric acid during 1 minute, rinsed with deionized water, dried with acetone and weighed. The corrosion rates were then calculated from the weight loss of the coupons. The average results of duplicate experiments are summarized in table 9.

TABLE 9

Corrosivity of aqueous solutions of ammonium chloride salts

| compound | corrosion rate (mm/year) |
|---|---|
| ammonium chloride | 0.90 |
| monoethanolammonium chloride | 0.40 |
| choline chloride | 0.10 |
| TEA-Cl | 0.08 |
| TBA-Cl | 0.07 |
| DEDMA-Cl | 0.10 |
| TEMA-Cl | 0.08 |

It can be seen from table 9 that the corrosivity of the chloride salts derived from quaternary ammonium hydroxides (I) is much lower than the corrosivity of ammonium chloride and MEA-Cl, and thus matches the low corrosivity of choline chloride.

Example 9

Thermal Stabilities of Solutions of Chloride Salts Derived from Quaternary Ammonium Hydroxides of Formula (I)

The experiments described in example 2 were repeated with 100 ppm (by weight) aqueous solutions of the chloride salts derived from quaternary ammonium hydroxides (I) at a temperature of 220° C. over a period of 4 hours. Choline chloride was used as reference. The results of duplicate experiments are shown in table 10.

TABLE 10

Thermal stability of aqueous solutions of chloride salts over 4 hours at 220° C

| compound | stability (%) |
|---|---|
| choline chloride | 70 |
| TEA-Cl | 95 |
| TPA-Cl | 95 |
| TBA-Cl | 92 |
| DEDMA-Cl | 98 |
| TEMA-Cl | 98 |

It can be seen from table 10 that the stabilities of the chloride salts are generally higher than those of their parent hydroxides (compare results listed in table 2). It can additionally be seen that the stabilities of dissolved chloride salts derived from ammonium hydroxides (I) are higher compared to that of the choline chloride solution. The lower stability of choline chloride in aqueous solution is quite surprising in view of the high thermal stability of solid choline chloride (see table 6).

Example 10

Thermal Decomposition of Chloride Salts Derived from Quaternary Ammonium Hydroxides of Formula (I)

Small amounts of pure chloride salts derived from quaternary ammonium hydroxides (I) were subjected to pyrolysis and the thus obtained compositions were then analyzed by gas chromatography coupled to mass spectrometry (pyrolysis GC/MS). The conditions were as follows:

pyrolysis temperature: 760° C., pyrolysis time: 20 s;

column: CP-select 624 CB capillary column (Agilent Technologies), length: 30 m, film thickness: 1.8 μm, inner diameter: 320 μm;

detector: mass sensitive detector, compound identification: by comparison with NIST17 spectral database.

The main decomposition products of the compounds are listed in table 11.

TABLE 11 main decomposition products of chloride salts derived from quaternary ammonium hydroxides (I)

| compound | main decomposition products |
|---|---|
| TEA-Cl | ethylchloride, triethylamine |
| TPA-Cl | n-propylchloride, tri-n-propylamine |
| TBA-Cl | n-butylchloride, tri-n-butylamine |
| DEDMA-Cl | methylchloride, ethylchloride, ethyldimethylamine, diethylmethylamine |

TABLE 11-continued

| main decomposition products of chloride salts derived from quaternary ammonium hydroxides (I) | |
|---|---|
| compound | main decomposition products |
| TEMA-Cl | methylchloride, ethylchloride, diethylmethylamine, triethylamine |

Table 11 shows that the chloride salts derived from quaternary ammonium hydroxides (I) decompose into the corresponding organic chlorides and tertiary amines and, in particular, that in all cases virtually no hydrogen chloride is formed. This is in line with what is stated in N. Collie et al., J. Chem. Soc., Trans. 1890, 57, 767-782; J. Blazejowski et al., Thermochim. Acta 1985, 92, 811-814; K. M. Harmon et al., Inorg. Chem. 1981, 20(11), 4013-4015; K. M Harmon et al., Journal of Molecular Structure 1989, 213, 193-200 and J. Blazejowski et al., Thermochim. Acta 1986, 105, 257-285.

As a representative example, the pyrolysis GC/MS partial chromatogram of DEDMA-Cl pyrolysis is given as FIG. 1. If present, HCl would appear at very short retention time. No HCl could be detected in the pyrolysis of DEDMA-Cl.

Example 11

Capacity of the Chloride Salts Derived from Ammonium Hydroxides (I) to Retain Hydrogen Chloride The hydrogen chloride retaining capacities of the chloride salts derived from quaternary ammonium hydroxides (I) were tested in analogy to the method described in U.S. Pat. No. 8,177,962 (see test example 1). Specifically, an automatic distillation unit was used, such as those employed for automatic distillation of crude oil samples (compare ASTM D 86, IP 123 and ISO 3405). Each sample consisted of 95 wt. % of a heavy aromatic solvent having a boiling range of 180 to 210° C. and 5 wt. % of an aqueous phase containing 9 mmol of a chloride salt derived from TEAH, i.e. a ammonium hydroxide (I). The chloride salts ammonium chloride, monoethanolammonium chloride and choline chloride were used as references. The samples were distilled to the dry points in the automatic distillation apparatus maintaining a constant distillation rate. The aqueous phases of the obtained distillates were separated from the supernatant organic phases and the chloride ion concentrations therein were measured via titration with silver nitrate. The average results of triplicate experiments are given in table 12.

TABLE 12

| distillation test results | |
|---|---|
| chloride salt | chloride concentration in condensate (ppm) |
| ammonium chloride | 2106 |
| monoethanolamninium chloride | 561 |
| choline chloride | 77 |
| TEA-Cl (tetraethylammonium chloride) | 54 |

It can be seen from table 12 that choline chloride and TEA-Cl release much less chloride ions than ammonium chloride and monoethanolammonium chloride. Hence, the HCl retaining capacity of TEA-Cl is at least as high as that of choline chloride.

The invention claimed is:

1. A method for reducing or preventing corrosion or fouling in an apparatus for carrying out a chemical process, where the corrosion or fouling is caused by acidic compounds present in the chemical process, which chemical process is a crude oil refinery process, a petrochemical process or a steam generating process, which method comprises the addition of at least one quaternary ammonium hydroxide of the formula (I) to the apparatus, wherein the chemical process is carried out:

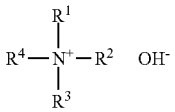

(I)

where $R^1$, $R^2$, $R^3$ are each independently $C_1$-$C_6$ alkyl;

$R^4$ is $C_2$-$C_{18}$ alkyl;

$R^3$ and $R^4$ together with the nitrogen atom may also form a 5 or 6-membered, saturated nitrogen heterocycle, which is unsubstituted or carries 1 or 2 methyl groups where the chemical process is a crude oil refinery process or a petrochemical process and comprises the addition of the compound of the formula (I) into at least one unit selected from the crude oil atmospheric distillation unit, the crude oil vacuum distillation unit, the visbreaker unit, the delayed coker unit, the fluidized catalytic cracking unit, the reformer unit, the hydrocracker unit, the alkanolamine unit, the sulfinol unit and the hydrodesulfurization unit, or where the chemical process is a steam generating process and comprises the addition of the compound of the formula (I) into the aqueous system of the boiler or steam generator;

and where the acidic compounds causing corrosion or fouling in the chemical process are selected from the group consisting of hydrogen halides, hydrogen sulfide, hydrogen cyanide, thiocyanic acid, sulfuric acid, $SO_2$, $SO_3$, acidic ammonium salts and mixtures thereof.

2. The method of claim 1, where in formula (I)

$R^1$, $R^2$, $R^3$ are each independently $C_1$-$C_6$ alkyl and $R^4$ is $C_2$-$C_6$ alkyl.

3. The method of claim 1, where the compound of formula (I) is selected from the group consisting of diethyldimethylammonium hydroxide, ethyltrimethylammonium hydroxide, dimethyldipropylammonium hydroxide, triethylmethylammonium hydroxide, tetraethylammonium hydroxide, tetra-n-propylammonium hydroxide, tetra-n-butylammonium hydroxide, hexamethonium hydroxide and N,N-dimethylpyrrolidinium hydroxide.

4. The method of claim 3, where the compound of formula (I) is selected from the group consisting of diethyldimethylammonium hydroxide, ethyltrimethylammonium hydroxide, dimethyldipropylammonium hydroxide, triethylmethylammonium hydroxide, tetraethylammonium hydroxide, tetra-n-propylammonium hydroxide and tetra-n-butylammonium hydroxide.

5. The method of claim 1, where the acidic compounds present in the chemical process include at least one acidic compound selected from the group consisting of acidic ammonium salts ammonium hydrogensulfide, ammonium sulfide, ammonium hydrogensulfate, and ammonium sulfate.

6. The method of claim 1, where the chemical process is a crude oil refinery process or a petrochemical process, which comprises the addition of the compound of the formula (I) into at least one unit selected from the crude oil atmospheric distillation unit, the crude oil vacuum distillation unit, the visbreaker unit, the delayed coker unit, the fluidized catalytic cracking unit, the reformer unit, the hydrocracker unit, the alkanolamine unit, the sulfinol unit and the hydrodesulfurization unit.

7. The method of claim 1, where the chemical process is a steam generating process, where the compound of the formula (I) is added into the fluid or gaseous stream of the steam generating process.

8. The method of claim 1, where the compound of the formula (I) is added into the fluid or gaseous stream of the chemical process.

9. The method of claim 8, where the fluid or gaseous stream is subjected to a temperature of at least 100° C., frequently at least 150° C. and especially at least 180° C. during or after the addition of the compound of formula (I).

10. The method of claim 8, where the compound of the formula (I) is added in an amount of 1 to 1000 ppm by weight, based on the amount of the fluid or gaseous stream of the chemical process.

11. The method of claim 1, where the compound of the formula (I) is added into the chemical process as a solution of at least one compound of the formula (I).

12. The method of claim 11, where the at least one compound of the formula (I) is dissolved in a solvent selected from $C_1$-$C_4$ alkanols, water and mixtures thereof.

13. The method of claim 11, where the total concentration of the compound of the formula (I) in the solution is in the range from 10 to 60% by weight.

14. The method of claim 5, wherein the ammonium salts are ammonium halides.

* * * * *